US005722800A

United States Patent [19]

Esters

[11] Patent Number: 5,722,800

[45] Date of Patent: Mar. 3, 1998

[54] SEAL AND ITS PRODUCTION METHOD FOR THE CREATION OF LOAD BEARINGS, REMOVABLE EARTH MASSES FOR THE CONSTRUCTION OF UNDERGROUND STRUCTURES SUCH AS CAVITY STRUCTURES

[75] Inventor: Klaus Esters, Essen-Kettwig, Germany

[73] Assignee: Keller Grundbau GmbH, Germany

[21] Appl. No.: 903,883

[22] Filed: Jun. 25, 1992

Related U.S. Application Data

[63] Continuation of Ser. No. 737,833, Jul. 29, 1991, abandoned, which is a continuation of Ser. No. 234,396, Aug. 19, 1988, abandoned, which is a continuation of Ser. No. 819,212, Jan. 15, 1986, abandoned.

[30] Foreign Application Priority Data

Jan. 15, 1985 [DE] Germany ..... 35 01 128.9

[51] Int. Cl.[6] ..... E21D 9/00

[52] U.S. Cl. ..... 405/267; 405/36; 405/138; 405/270

[58] Field of Search ..... 405/36, 38, 50, 405/52, 53, 55, 132, 136, 137, 138, 258, 266, 267, 269, 270

[56] References Cited

U.S. PATENT DOCUMENTS

| | | | |
|---|---|---|---|
| Re. 17,207 | 2/1929 | Collngs | 405/270 X |
| 2,154,233 | 4/1939 | Donaldson | 405/270 X |
| 2,329,223 | 9/1943 | Schmidt | 405/275 X |
| 2,782,605 | 2/1957 | Wertz et al. | 405/269 X |
| 2,853,851 | 9/1958 | Mintz | 405/266 |
| 3,608,318 | 9/1971 | Levy et al. | 405/269 X |
| 4,047,387 | 9/1977 | Tamura et al. | 405/38 |
| 4,090,363 | 5/1978 | List et al. | 405/109 |
| 4,193,716 | 3/1980 | Piccagli | 405/267 |
| 4,209,337 | 6/1980 | Wagner et al. | 106/96 |
| 4,212,565 | 7/1980 | Watabe | 405/267 X |
| 4,340,510 | 7/1982 | Howanietz et al. | 260/8 |
| 4,351,750 | 9/1982 | Ferm et al. | 524/8 |
| 4,447,267 | 5/1984 | Chesney et al. | 106/93 |
| 4,648,743 | 3/1987 | Sauer | 405/138 |

FOREIGN PATENT DOCUMENTS

| | | | |
|---|---|---|---|
| 2428302 | 1/1976 | Germany | 405/55 |
| 3621884 | 1/1987 | Germany | 405/38 |
| 1033751 | 8/1983 | U.S.S.R. | 405/270 |
| 958745 | 5/1964 | United Kingdom | 405/55 |

*Primary Examiner*—John A. Ricci
*Attorney, Agent, or Firm*—Bierman, Muserlian and Lucas

[57] ABSTRACT

A bulkhead for manufacturing underground structures such as earth cavities in a closed construction method, formed of sealing walls arranged as an enclosure and sealing earth masses to be removed against ground water, wherein the sealing walls are formed of a hardened mixture of bentonite-cement injected under pressure into the ground, characterized in that the sealing walls inserted into fine sand or silts are arranged in the form of a roof and are formed as a substantially elastically deformable bulkhead envelope by adding filler to the mixture of bentonite-cement. Preferably, the bulkhead sealing walls of the bulkhead envelope extend from a central ridge line on the earth surface or below it downwardly in an obliquely diverging direction into water-impermeable soil. The bulkhead can be made airtight so that a vacuum can be applied to the earth mass enclosed by the bulkhead envelope.

2 Claims, 7 Drawing Sheets

Figure 1:
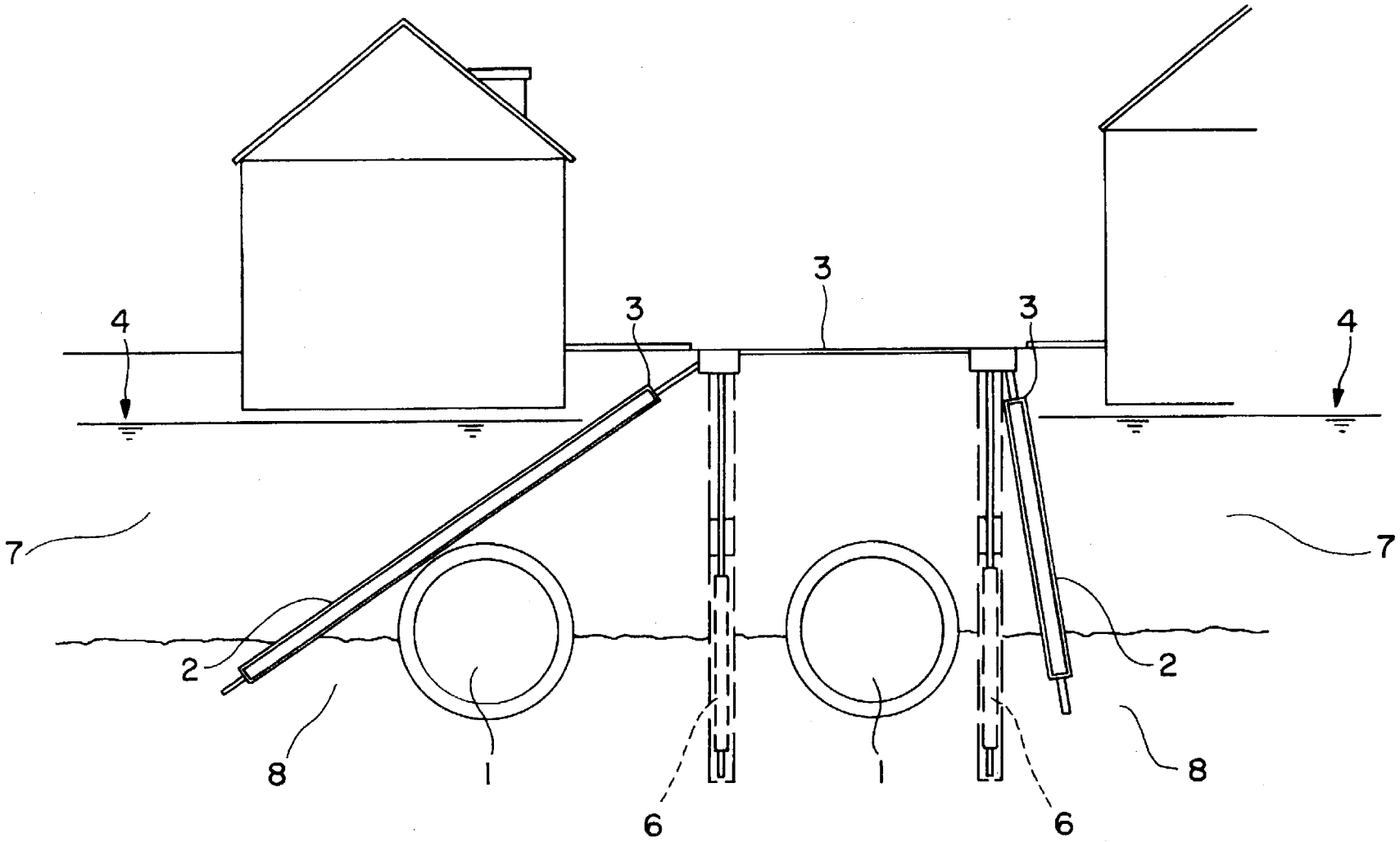

SEAL AND ITS PRODUCTION METHOD FOR THE CREATION OF LOAD BEARINGS, REMOVABLE EARTH MASSES FOR THE CONSTRUCTION OF UNDERGROUND STRUCTURES SUCH AS CAVITY STRUCTURES

PRIOR APPLICATIONS

This application is a continuation of U.S. patent application Ser. No. 07/737,833 filed Jul. 29, 1991 which is a continuation of U.S. patent application Ser. No. 07/234,396 filed Aug. 19, 1988 which is a continuation of U.S. patent application Ser. No. 06/819,212 filed Jan. 15, 1986, all now abandoned.

The invention relates to a seal and to a production method for forming a seal to create load bearing, removable earth masses for the construction of underground structures such as cavity structures or the like.

Lowering the groundwater level as a construction expediency when building underground structures below the groundwater level should be prevented if at all possible for legal and environmental reasons. To be able nevertheless to provide the deep "open" construction pits below the groundwater level in a dry state it is necessary to enclose the construction site area with watertight lining walls which must go down to the level of a water-impermeable soil layer.

Since such lining walls, besides their great depth, must also be designed to withstand the external groundwater pressure, this construction mode is very costly.

Even more expensive are the underground "closed" construction pits. These pits are made by shield driving with compressed air or by fluid-assisted local facing, alternatively, the groundwater is frozen in the construction area.

The described methods for forming closed construction pits are extremely costly.

Therefore, in view of the state of the art, it is an object of the invention to provide a seal and a method by which a dry construction pit can be created without causing a long-term effect on the groundwater level.

The prior art problems are solved by the sealing means of the invention which comprises an elastic sealing shell 3 formed by sealing walls 2 arranged in the form of a roof, umbrella or housing to hermetically seal the earth masses to be removed from the ground water and/or the atmosphere. The method of removing load-bearing removable earth masses for the creation of underground structures comprises enclosing the mass to be excavated within a sealing shell with sealing walls in the form of a roof, housing or umbrella to seal out groundwater and/or air, draining any groundwater and air from the sealing shell whereby the sealing shell is compressed by the pressure of groundwater outside the shell and/or is stabilized by evacuation of air to obtain a firm, dry soil mass, and continuously removing the dry soil from the sealing shell as construction of the underground cavity progresses.

The seal provided according to the invention forms a load carrying, removable earth mass for the construction of underground structures such as cavity structures or the like, consists of an elastic sealing shell formed of sealing walls arranged in the form of a roof, an umbrella, a housing or the like, hermetically sealing the earth masses to be removed against groundwater and/or air.

It is of particular advantage for the elastic sealing walls of the sealing shell to consist of a hardened mixture of bentonite/filler/cement and/or solid/asphalt basis, which mixture can be injected into the ground under pressure.

Each sealing wall of the sealing shell is designed so that it consists of a sealing layer and/or overlapping columns formed by injection.

One particularly advantageous embodiment of the invention results from the sealing walls of the sealing shell extending from a central ridge line located on the surface or below it, diverging obliquely in a downward direction into the water-impermeable ground. This central ridge line, which may be a work tunnel or the like, represents in a rooflike or umbrellalike sealing shell, viewed in cross-section, the upper crest of the respective cross-sectional triangle. This makes it possible to advantageously provide the sealing shell with a surface of the least possible area and the greatest possible effect.

In further development of the invention it is also possible to close off the sealing shell on the bottom side, below the earth masses to be removed, using a laminar "soilcrete" part consisting of a solidified suspension put in place by injection.

The method according to the invention makes it possible to process the earth masses to be removed and the earth masses remaining below ground so that they can be removed continuously from a secure location and in a dry state. Yet, the method according to the invention is less costly than the known methods of shield driving or freezing.

In the method according to the invention, the earth masses in a sealing shell of the construction site to be removed dry are sealed against the groundwater and the air, drained, compacted by the pressure of the groundwater acting upon the outside of the sealing shell and/or stabilized by evacuation so that a load-bearing mass of firm and dry soil is obtained which can be processed continuously during construction of the underground structure and removed from a protected location in a dry state.

The method according to the invention eliminates to a large extent the disadvantages of the known watertight enclosing methods and allows the draining of the soil in the immediate area of the construction pit or underground structure.

This advantage is obtained primarily in that a sealing shell is formed which seals the construction area from which the earth masses are to be removed against the groundwater and the air.

The sealing shell is formed of sealing walls, the shape of which is adapted to the local conditions and which are produced by injecting into the earth masses to be sealed of a liquid mixture on bentonite/filler/cement basis or as solid/asphalt mixture as high-pressure suspension jet at pressures from 300 to 600 bar.

The tightness of the sealing shell can be insured in that the sealing walls can be re-injected at washed-out and eroded spots with injection media at pressures between 50 and 100 bar.

The injection and reinjection result in a homogeneous, elastic sealing wall of exact depth, width and height dimensions, produced of fatigue-resisting material not harmful to the environment.

The construction pit enclosed by the sealing shell can then be drained for the actual construction work and kept dry.

One significant advantage of the method according to the invention is that the sealing shell is able to adapt elastically to the volume reduction of the earth masses without endangering the sealing effect. Another decisive advantage of the method is that the sealing shell is able to absorb the groundwater pressure acting upon its outer skin so that an additional compaction of the ground in the enclosed drainage area is achieved.

The method according to the invention offers the further advantage that in case of unexpected leakages, the sealing shell can be resealed by reinforcement by means of valve pipes.

The sealing shell can also be used as an additional safety measure against air losses when compressed air drives with little soil cover are involved.

To avoid excessive earth volume reduction, a swelling agent may be added to the injection medium.

The method according to the invention also offers the possibility of producing the sealing shell by the soil fracturing method and stabilizing by reinjection.

Figure 2:
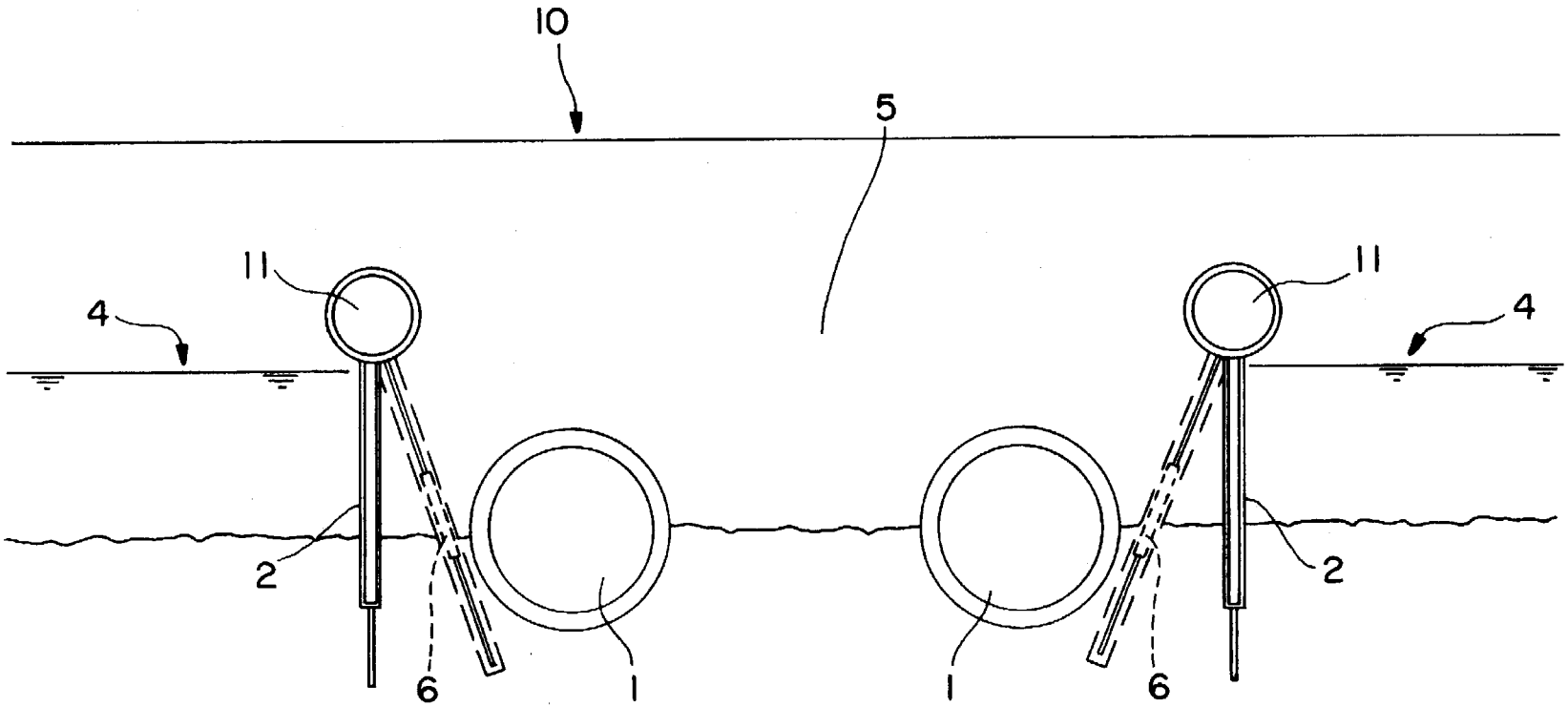
Figure 3:
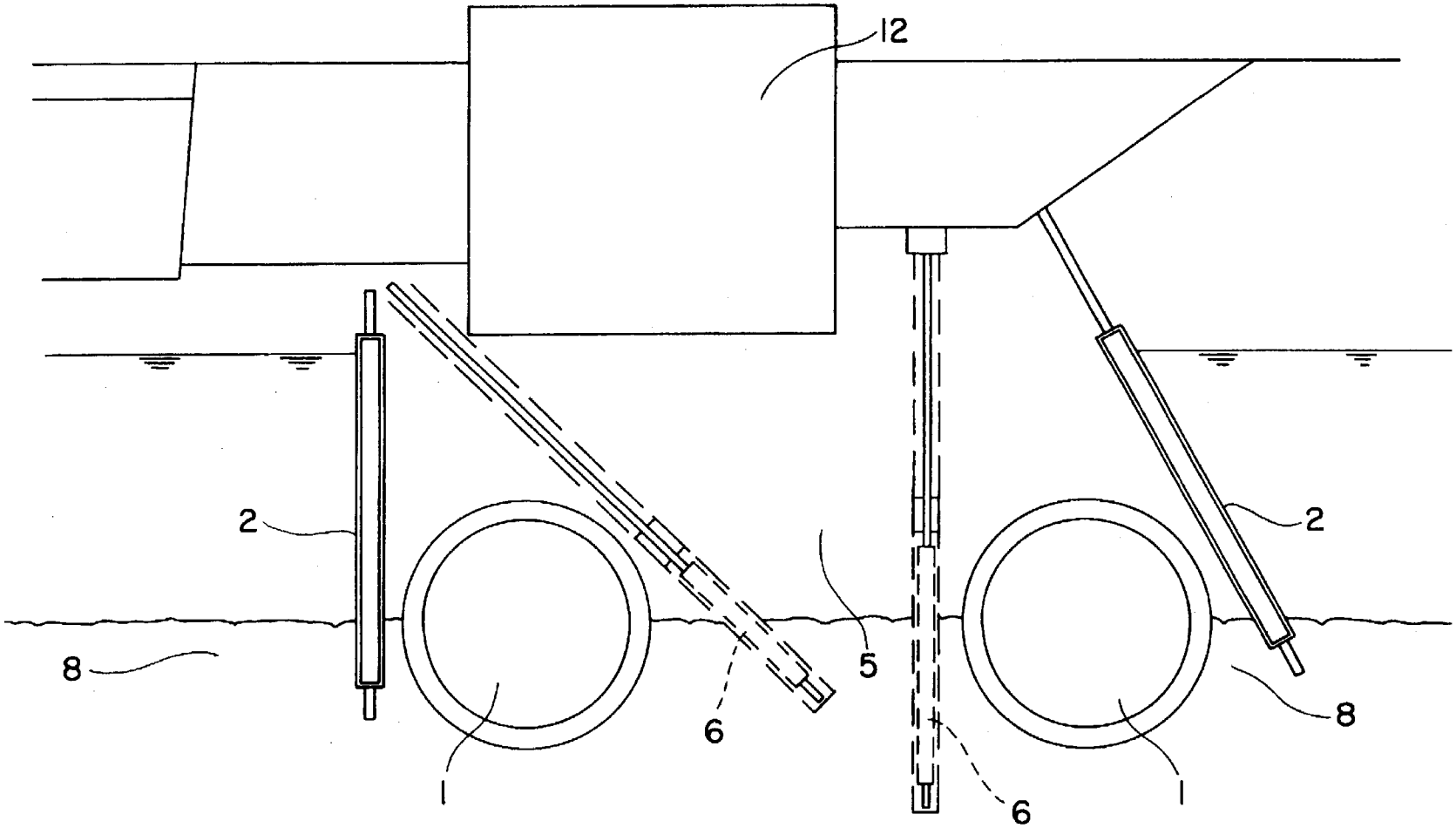
Figure 4:
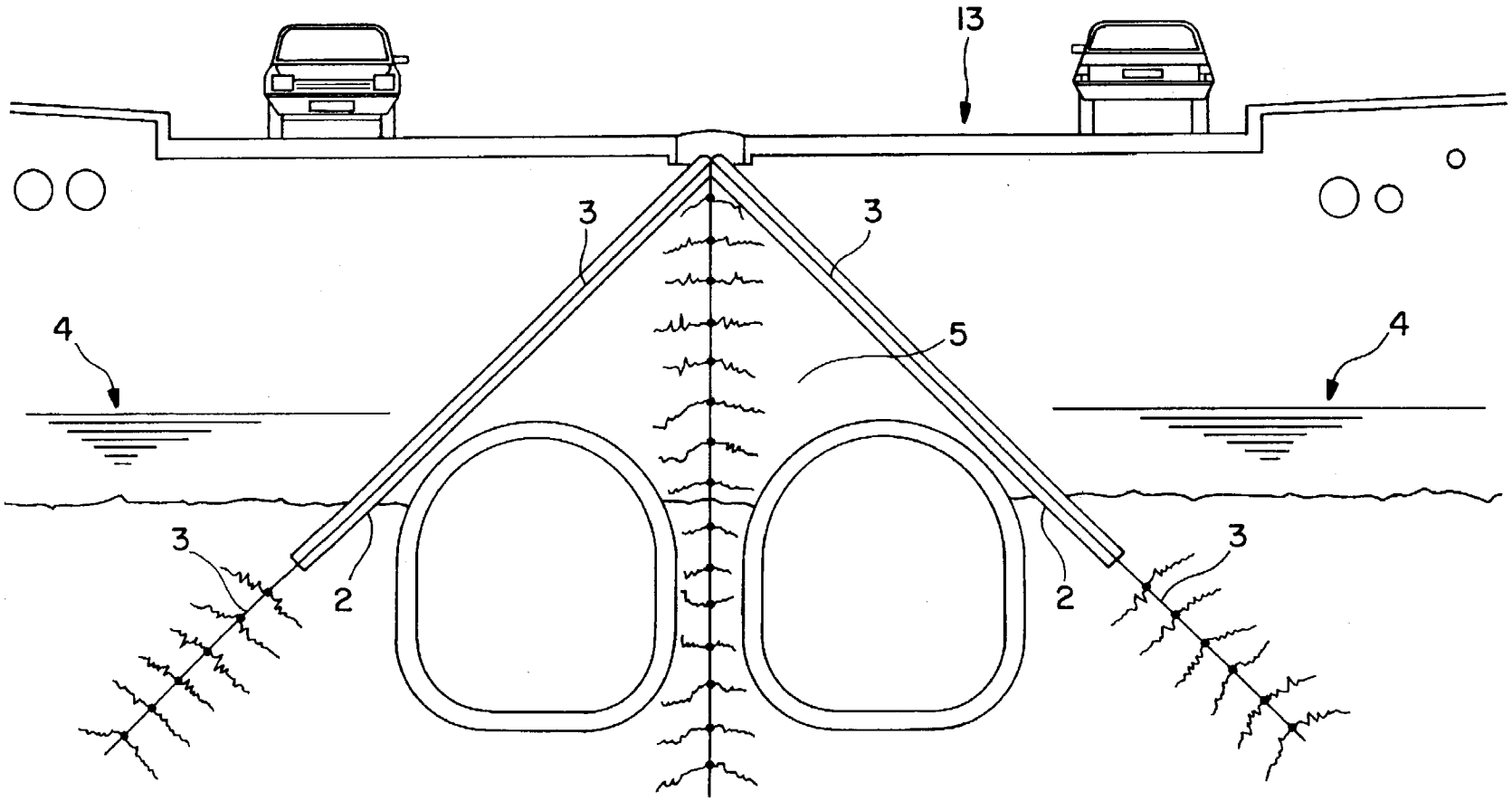
Figure 5:
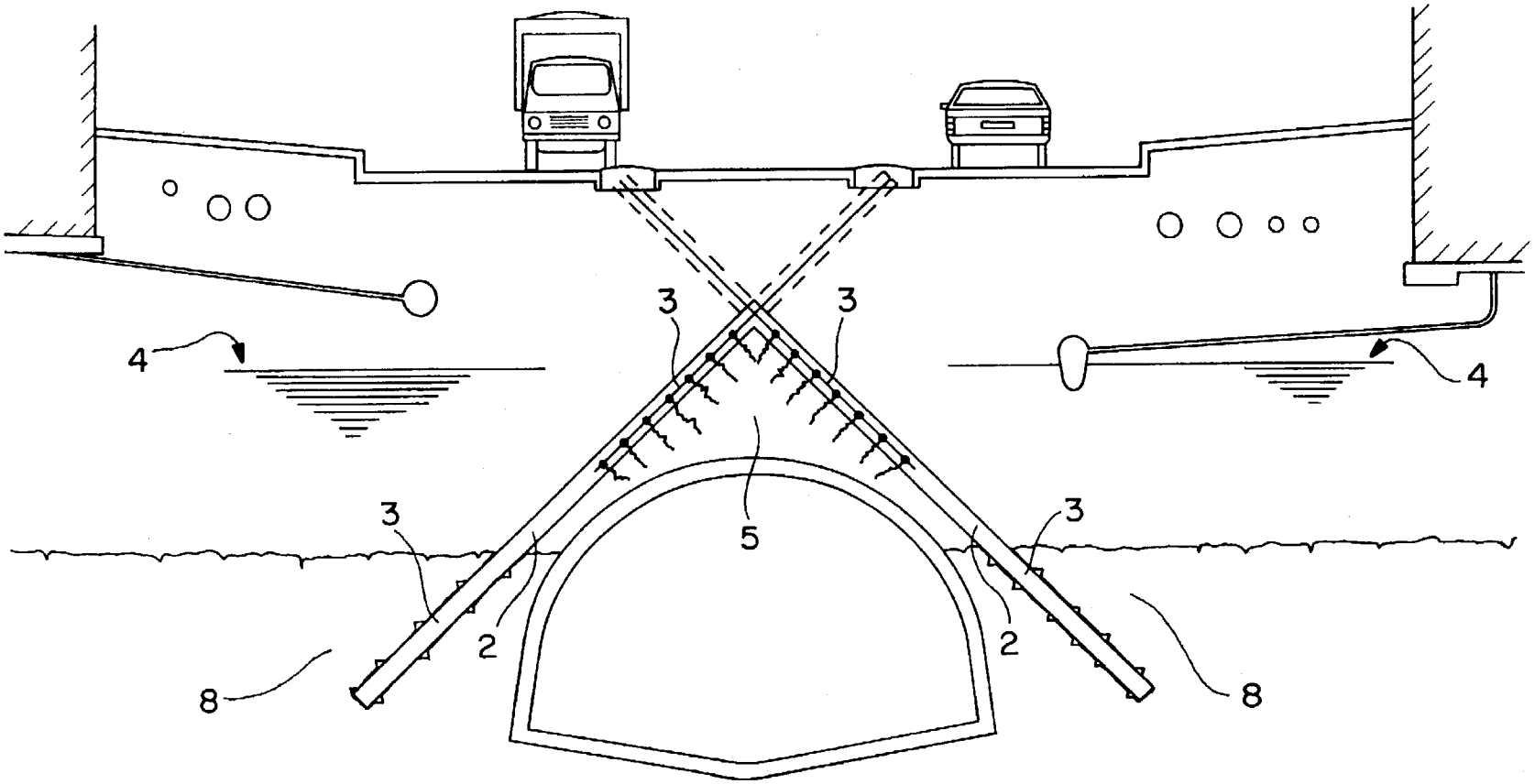
Figure 6:
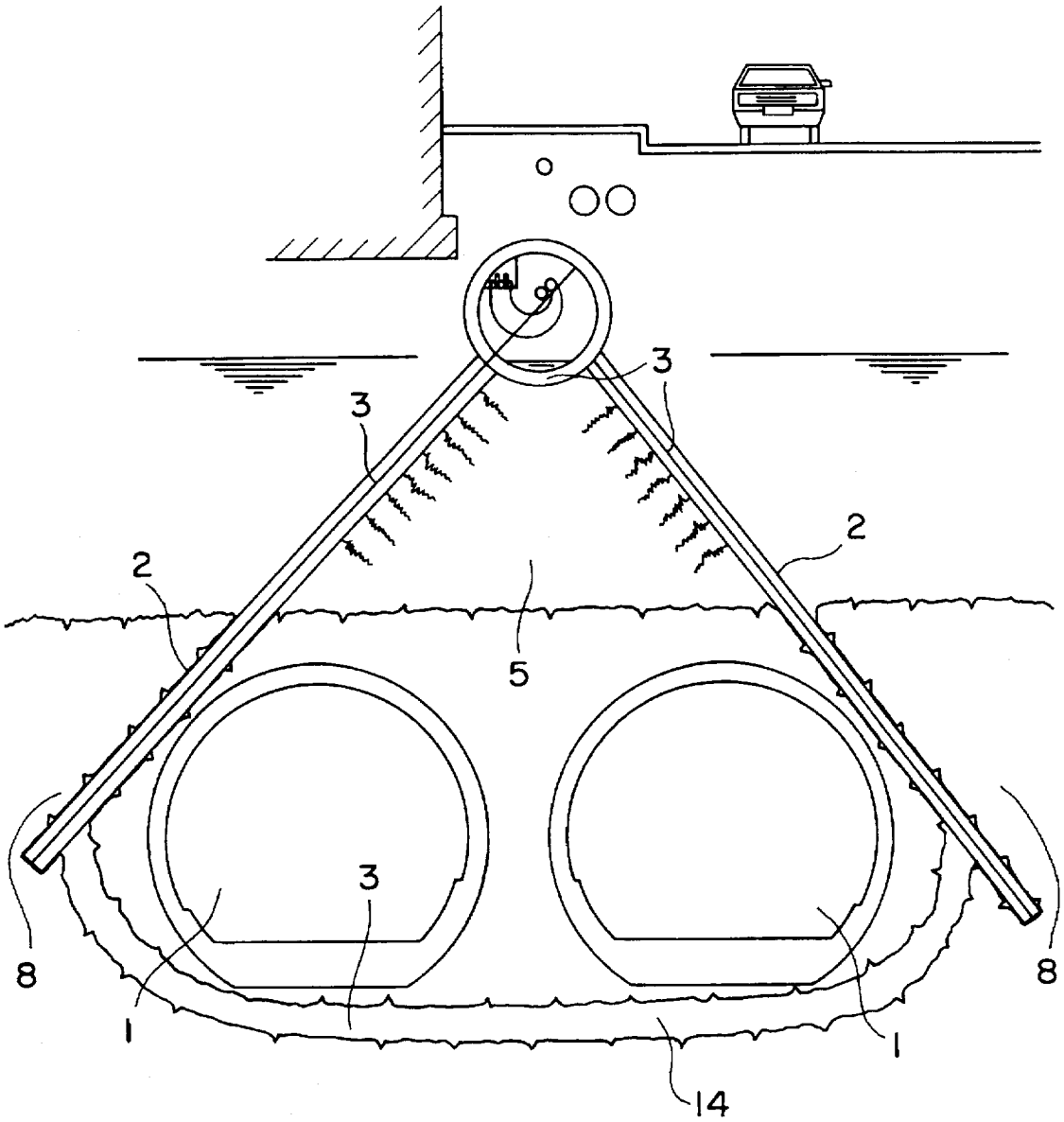
Figure 7:
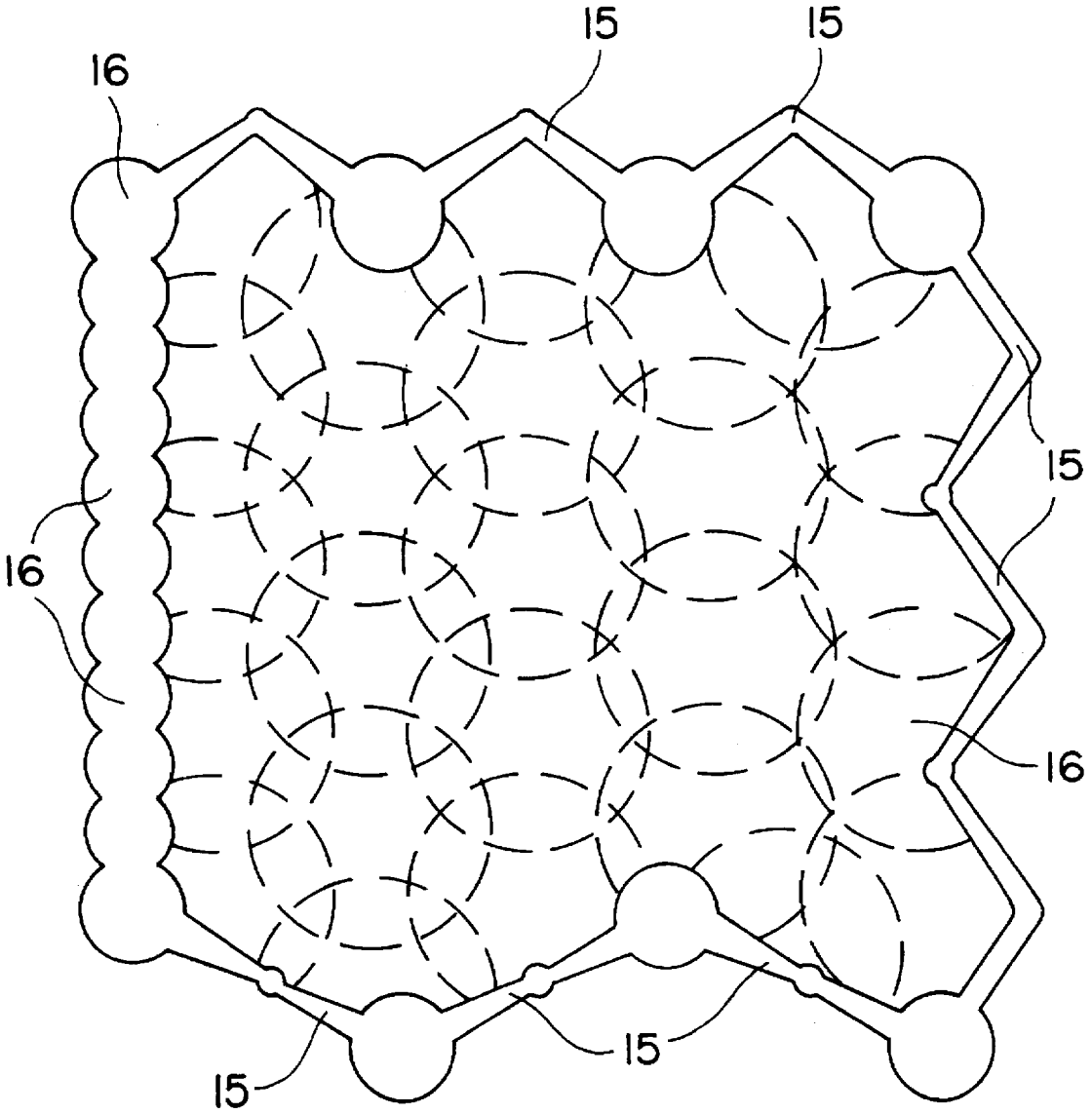

The invention is explained below in greater detail with reference to the drawing in which FIG. 1 shows the sealing shell in section, with elastic sealing walls in the area of the dry tunnel drive, FIG. 2 shows elastic sealing walls in conjunction with work tunnels for the dry drive area of subway tunnels, FIG. 3 illustrates the sealing shell with elastic sealing walls drained and vacuum stabilized, FIG. 4 shows a sealing shell as soilcrete roof pulled up, with ridge reinjection, FIG. 5 is a sealing shell as soilcrete roof, set deep with reinjection, FIG. 6 represents a sealing shell as soilcrete umbrella with soil fracturing and soilcrete bottom sealing, and FIG. 7 shows sealing wall shapes in plan view.

FIG. 1 shows a sealing shell 3 formed of sealing walls 2 and drained by vacuum deep walls 6 from the groundwater level 4 to a rock layer 8 so that subway tubes 1 can be driven forward in dry ground. The external pressure of the groundwater 4 in the coarse clay or fine sand 7 is absorbed by sealing walls 2. The sealing walls are tied into the rock layer 8. The construction site lies below the backfill.

FIG. 2 shows the underground construction of subway tunnels 1 below upper edge 10 of the terrain. The sealing walls 2 protect against the groundwater level 4. The soil 5 encompassed by sealing walls 2 is drained by vacuum walls 6 disposed in two work tunnels 11. This creates a zone of dry, stable soil 5 between sealing walls 2 in which driving operations can proceed.

FIG. 3 shows the construction of subway tubes 1 laid in dry soil under the building 12. For this purpose, soil 5 is enclosed by sealing walls 2, and is drained down to bottom layer 8 by vacuum deep wells 6 so that the underground structure can be built in drained and stabilized soil 5.

FIG. 4 shows an embodiment in Which sealing shell 3 consists of sealing walls 2 arranged in a roof shape. In this arrangement, a compressive effect is obtained by the pressure of outside water level 4 upon enclosed earth masses 5. The elastic sealing walls 2 adapt directly to a volume reduction without impairing the sealing function. The roof of the sealing shell is clearly pulled up to surface 13 in this embodiment.

In the embodiment according to FIG. 5, the roof, i.e. the sealing walls 2, is clearly pulled down to the rock layer 8, on the other hand. According to this embodiment, the volume of the sealing shell 3 is limited by sealing walls 2 being set low and the affected area is strictly restricted to drainage zone 5. This embodiment is particularly well suited for deep excavations in order to stop, when internal vacuum draining is involved, not only the entry of outside water 4, but also the entry of air from the outside, thereby making the underpressure for the soil stabilization associated therewith particularly effective.

FIG. 6 shows an embodiment in which sealing walls 2 are sunk deep into rock layer 8 so that enclosed sealing shell 3 can be severely restricted spatially. This, advantageously, makes the volume of soil 5 to be stabilized and drained very small in this embodiment. The two subway tubes 1 are driven forward in dry soil. Removing the earth masses from rock layer 8 is facilitated in that they can be compressed and stabilized by additional injections by the soil fracturing method. A soilcrete part 14 under subway tube 1 sections serves to secure the cavity structure below.

FIG. 7 shows plan views of elastic sealing wall 2 which may be constructed of sealing layer 15 or of overlapping columns 16 or a combination thereof.

Possible further or additional features of the invention not enumerated in the claims follow clearly, either singly or in mutual combination, from the specification and/or the drawing.

I claim:

1. A sealing system for use in construction in underground soil in which a volume of said soil is to be sealed against groundwater to allow drainage and removal of said volume of soil, said underground soil including an upper layer subject to saturation by groundwater, and a lower watertight layer, said sealing system comprising walls injected under pressure into the soil and encompassing said volume of soil as a roof, said walls having upper ends extending above said watertight layer and lower ends extending to said watertight layer, so that the encompassed volume is hermetically sealed, said walls composed of a composition including bentonite, cement, and a filler, which, when cured, will not become fully rigid, but will be elastically deformable, so that, as water is removed from the encompassed volume by a vacuum, the walls will be able to adapt to the volume reduction and further compress and seal the encompassed soil.

2. A sealing system as in claim 1, wherein the upper ends of said sealing walls meet at a central roof ridge at the upper end of the encompassed volume, and diverge obliquely downwardly into the watertight layer.

* * * * *